US008262055B2

(12) United States Patent
Costello et al.

(10) Patent No.: US 8,262,055 B2
(45) Date of Patent: Sep. 11, 2012

(54) STAIR FORMING APPARATUS AND RELATED METHODS

(75) Inventors: Anthony William Costello, Keri Keri (NZ); Trevor James Anderson, Keri Keri (NZ); John Owen Gardner, Keri Keri (NZ)

(73) Assignee: Any Step Technology Limited, Auckland (NZ)

( * ) Notice: Subject to any disclaimer, the term of this patent is extended or adjusted under 35 U.S.C. 154(b) by 613 days.

(21) Appl. No.: 12/382,304

(22) Filed: Mar. 12, 2009

(65) Prior Publication Data

US 2009/0266969 A1 Oct. 29, 2009

Related U.S. Application Data

(63) Continuation-in-part of application No. PCT/NZ2007/000250, filed on Sep. 12, 2007.

(30) Foreign Application Priority Data

| | | |
|---|---|---|
| Sep. 12, 2006 | (NZ) | 549797 |
| Feb. 14, 2007 | (NZ) | 553184 |
| Jun. 26, 2007 | (NZ) | 556177 |
| Mar. 13, 2008 | (NZ) | 566679 |

(51) Int. Cl.
*B28B 7/01* (2006.01)
*E04G 13/06* (2006.01)

(52) U.S. Cl. ..... 249/14; 249/139; 249/155; 249/159; 249/195; 249/208

(58) Field of Classification Search ..... 249/8, 14, 249/120, 139, 155–165, 168, 169, 195, 208, 249/219.1; 52/182, 183, 188–191, 702, 712; 264/333; 29/428, 525.01
See application file for complete search history.

(56) References Cited

U.S. PATENT DOCUMENTS 597,966 A * 1/1898 Emery ..... 182/228.3
(Continued)

FOREIGN PATENT DOCUMENTS

CN 1690333 11/2005
(Continued)

OTHER PUBLICATIONS

Translation of FR 2434016 A from EPO cite, pp. 1-3. No date available.*

(Continued)

*Primary Examiner* — Dimple Bodawala
(74) *Attorney, Agent, or Firm* — Jacobson Holman PLLC

(57) ABSTRACT

The invention relates to an adjustable stair forming apparatus, adapted to form a flight of stairs of a settable material. The flight of stairs including a series of treads interconnected by intermediate risers. The apparatus comprises, a frame to support a series of forming units provide a forming surface. Each forming unit, includes a tread defining formwork that includes a rectangular shaped tread forming surface, slidably and pivotally mounted to the frame from or toward a first major edge of the tread forming surface. The forming unit also has a riser defining formwork that includes a rectangular shaped riser forming surface with a first major edge adjustably mounted from or toward the opposite major edge of the tread forming surface. The riser forming surface at least in part co-extending with the tread forming surface in a stair width direction. The forming units each adjustably held in an array to the frame with a bearing surface of one forming unit supported by a tread forming surface of the adjacent forming unit.

20 Claims, 13 Drawing Sheets

U.S. PATENT DOCUMENTS

| | | | | | |
|---|---|---|---|---|---|
| 1,319,385 | A | * | 10/1919 | Gottschalk | 249/208 |
| 2,353,676 | A | * | 7/1944 | Kogl | 249/14 |
| 2,702,931 | A | * | 3/1955 | Johnson | 249/14 |
| 3,470,664 | A | * | 10/1969 | Whitehead | 52/183 |
| 3,885,365 | A | | 5/1975 | Cox | |
| 4,714,231 | A | | 12/1987 | Coleman | |
| 5,086,595 | A | * | 2/1992 | Maiuccoro et al. | 52/183 |
| 5,133,530 | A | | 7/1992 | Thoresen | |
| 5,511,347 | A | * | 4/1996 | Schwarz | 52/182 |
| 6,029,408 | A | * | 2/2000 | Cavaness | 52/188 |
| 2004/0020142 | A1 | * | 2/2004 | Kress | 52/185 |
| 2005/0160688 | A1 | * | 7/2005 | Truckner et al. | 52/182 |
| 2005/0210775 | A1 | * | 9/2005 | Grinstead | 52/182 |
| 2008/0040991 | A1 | * | 2/2008 | Gianelo | 52/182 |
| 2008/0115429 | A1 | * | 5/2008 | Zirbel et al. | 52/189 |
| 2008/0163571 | A1 | * | 7/2008 | Kohler | 52/183 |

FOREIGN PATENT DOCUMENTS

| | | | | |
|---|---|---|---|---|
| DE | 3518200 | C1 | * | 8/1986 |
| DE | 42 06 322 | | | 9/1993 |
| DE | 4206322 | | | 9/1993 |
| DE | 29611320 | U1 | * | 10/1996 |
| DE | 19546050 | | | 12/1996 |
| DE | 19816720 | | | 7/1997 |
| EP | 1 917 711 | | | 8/1986 |
| EP | 0658408 | | | 6/1995 |
| FR | 2434016 | A | * | 4/1980 |
| FR | 2660234 | A1 | * | 11/1991 |
| GB | 2193922 | | | 2/1988 |
| GB | 2217359 | A | * | 10/1989 |
| GB | 2 193 922 | | | 2/1998 |
| GB | 2 347 106 | | | 8/2000 |
| JP | 02272155 | A | * | 11/1990 |
| JP | 06042177 | A | * | 2/1994 |
| JP | 08312090 | A | * | 11/1996 |
| JP | 2000282681 | A | * | 10/2001 |
| JP | 2001295441 | A | * | 10/2001 |
| WO | WO 02/077394 | | | 10/2002 |

OTHER PUBLICATIONS

Translation of DE 195 46 050 C1 from EPO cite, pp. 1-2, no date available.*

International Search Report dated Dec. 7, 2007.

* cited by examiner

STAIR FORMING APPARATUS AND RELATED METHODS

This is a Continuation-in-Part of PCT/NZ07/000,250 filed Sep. 12, 2007 and published in English, which has priorities of New Zealand no. 549797 filed Sep. 12, 2006, New Zealand no. 553184 filed Feb. 14, 2007, and New Zealand no. 556177 filed Jun. 26, 2007. The priority of New Zealand no. 566679 filed Mar. 13, 2008, is also hereby claimed. All of the noted priority documents including PCT/NZ07/000,250 are hereby incorporated by reference as if set forth in their entirety.

FIELD OF THE INVENTION

The present invention relates to adjustable stair forming apparatus and related methods for moulding concrete, or similar settable materials, to define a flight of stairs wherein adjustments to the apparatus can allow for differing flights to be made having different width, tread length, riser height, nosing length, stair pitch, landings and similar.

BACKGROUND

Traditionally when concrete, or other similar formable or settable material, is used to form stairs, a mould is made for the exact form of the flight of stairs required. Concrete is then poured into the mould. The concrete is then allowed to set and the resulting flight of stairs is removed from the mould.

This is an expensive method of forming stairs, as for each different flight of stairs a new mould is required.

There has therefore been a long felt want for a product that will allow numerous different stair shapes to be formed without needing to invest in numerous different moulds.

Typically moulds have been made from wood to keep the cost down. In moulding environments wood has a limited life. It eventually breaks down from wear and tear, requiring a new mould to then be made.

U.S. Pat. No. 5,133,530 discloses a stair forming apparatus. A key short coming of U.S. Pat. No. 5,133,530 is its inability to adjust the nosing of the stairs. The nosing is the distance of the overlap of two adjacent stairs treads. US '530 specifically states that the invention can only produce a right angle stair profile. In many countries, regulations and rules for stair designs govern the maximum and minimum lengths of the treads, risers and nosing for any particular stair type eg. public access, main private stairways etc. The ability to extend the actual tread length by adding a nosing is very helpful to architects and designers when limited room is available.

In addition the individual units in U.S. Pat. No. 5,133,530 must all be set at the same unit pitch, there is no ability to vary the pitch between units, only globally of all the units. This also increases the difficulty of adding and removing units to form more or less stairs. The mechanism used in their apparatus also increases the cost of the apparatus and makes it less portable.

It is therefore an object of the present invention to provide a stair forming apparatus and/or related methods that at least overcomes some of the problems of the prior art, or to at least address the above desiderata, or at least provide the public with a useful choice.

In this specification if and where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

BRIEF DESCRIPTION OF THE INVENTION

In a first aspect the present invention consists in an adjustable stair forming apparatus, to form, in an inverted condition, a flight of stairs of a settable material, each stair of said flight including a tread and a riser, said apparatus comprising, a frame, a plurality of abutting forming units to receive the settable material, each forming unit reconfigurably mounted from said frame in:

(a) a pivotal manner about an axis parallel to pivot axes of the other forming units, said axis extending in a direction parallel to the width direction of the flight of stairs to be formed, and (b) a translational manner in a direction perpendicular to the width direction, each of said forming units comprising, (i) a tread forming member defining a tread forming surface with an upper edge, and (ii) a riser forming member defining a riser forming surface of a fixed shape and that includes a. a first edge bearing on the tread forming member at or toward said upper edge of said tread forming member, and b. a bearing edge parallel to and distal from said first edge, said riser forming surface at least in part co-extending in said width direction with said tread forming surface, said plurality of forming units each arranged relative said frame with said bearing edge of one said forming unit located by an adjustable support means at a said tread forming surface of an adjacent said forming unit, adjustment of said support means rotationally positioning said riser forming member relative said tread forming member to allow the angle between said riser forming surface and said tread forming surface to be varied to set the desired amount of tread protection, wherein prior to receiving said settable material, said forming units can be configured to a desired configuration, adjustment of said forming units relative each other allowing forming of differently shaped flights of stairs.

Preferably each said tread forming member is rotatably mounted about a respective first said axis ("first axis") to said frame at a location distal and below the upper edge of said tread forming member.

Preferably said forming units act in concert to collectively provide a forming surface.

Preferably said direction perpendicular to the width direction is in the flight or pitch line direction ("first direction") of said flight of stairs.

Preferably said tread protection can be set by adjustment of the adjustable support means by which the riser forming member is located at said tread forming member of an adjacent forming unit, said adjustment moving the support means over the tread forming surface of an adjacent said forming unit.

Preferably the number of stairs to be formed is adjusted by removing or adding one or more forming units to said frame.

Preferably the riser height of a forming unit is adjusted by using varying riser forming members of different heights.

Preferably said first edge is rotatably mounted from or toward said upper edge at an abutment at or toward said upper edge.

Preferably said stair width is adjusted by a pair of side mould surfaces parallel to said first direction, both profiled to seal against said plurality of forming units and at least one of which is adjustable in location on said forming units.

Preferably said tread forming member is also pivotally mounted on a second said axis ("second axis"), parallel to said first axis, to said frame at or toward said upper edge of said tread forming member.

Preferably said frame consists of a first and second parallel side frames that each run along a first side and second side of said plurality of forming units in said first direction that is perpendicular to said width direction.

Preferably each frame includes a pair of vertically spaced apart horizontally extending rails comprising a first rail and said second rail below said first rail, vertically moveable relative said first rail.

Preferably said tread forming members of said plurality of forming units are each pivotally and slidably connected, directly or indirectly, between said first and second side frames.

Preferably each said tread forming member is slidably and pivotally mounted to said first rail from or toward said upper edge and slidably and pivotally mounted to said second rail from or toward a location distal and below the upper edge of said tread forming member to allow (i) their horizontal spacing to be adjusted along said rails and (ii) their angle to be varied relative to the vertical upon the movement of said first and second rail vertically relative each other.

Preferably said adjustment of said adjustable support means is by complimentary threaded components.

Preferably said tread forming members and said riser forming members are substantially rectangular in shape.

In yet a further aspect the present invention consists in an adjustable stair forming apparatus, adapted to form a flight of stairs of a settable material in an inverted condition, said flight of stairs including a series of treads interconnected by intermediate risers, said apparatus comprising or including, a plurality of forming units, acting in concert to collectively provide a forming surface, a frame to support said forming units, each of said forming units including, (a) a tread defining formwork that includes a rectangular shaped tread forming surface, slidably and pivotally mounted to said frame from or toward a first major edge of said tread forming surface, and (b) a riser defining formwork that includes a rectangular shaped riser forming surface with a first major edge located at the opposite major edge of said tread forming surface in a rotationally adjustable manner relative thereto, said riser forming surface at least in part co-extending with said tread forming surface in a stair width direction, said riser forming surface including a bearing surface parallel to and distal from its said first major edge, said plurality of forming units each adjustably held in an array by and/or relative to said frame with said bearing surface of each riser defining formwork supported against the tread forming surface of an adjacent said forming unit by an adjustable support member that can move relative to the tread forming surface of the adjacent forming unit to allow it to be set in a position to support the riser in a position to define a desired amount of tread protection of the tread to be so formed.

In even a further aspect the present invention consists in an adjustable stair flight forming system to form a flight of stairs of a settable material in an inverted condition, said flight including a plurality of stairs each including a tread and a riser that extend substantially perpendicular to each other, adjustment of said apparatus allowing for the forming of different flights of different shaped treads and/or risers to occur, said apparatus including:

a frame, a plurality of tread defining formwork elements, each including a tread forming surface to each define a said tread of a stair, movably engaged to and supported by said frame in a spaced apart manner, and at least two sets of a plurality of identical riser defining formwork elements, each including a riser forming surface to define a said riser of a stair, wherein the angle between a said tread forming surface and a said riser forming surface of each said stair can be adjustably set yet setting the tread forming surfaces of adjacent stairs parallel to each other by virtue of;

(a) said adjustable support of each said tread defining formwork element relative said frame and relative the other said tread defining form work elements, and (b) selection of an appropriate set of said riser defining formwork elements that comprises of riser defining form work elements of a size that can span and close the space between adjacent said tread defining formwork elements.

In still a further aspect the present invention consists in an adjustable stair forming apparatus, adapted to form a flight of stairs of a settable material in an inverted condition, said flight of stairs including a series of treads interconnected by intermediate risers, said apparatus comprising or including, a plurality of forming units, acting in concert to collectively provide a forming surface, a first pair of horizontally spaced apart rails and a second pair of horizontally spaced apart rails located below said first pair of rails to support said forming units extending between each said first pair of rails and second pair of rails, wherein said first pair of rails and said second pair of rails are vertically moveable relative each other, each of said forming units including, (c) a tread defining formwork that includes a rectangular shaped tread forming surface slidably and pivotally mounted to said second pair of rails from or toward a first major edge of said tread forming surface and slidably and pivotally mounted to said first pair of rails from or toward a second major edge of said tread forming surface, (d) a riser defining formwork that includes a rectangular shaped riser forming surface with a first major edge to be located at the second major edge of said tread forming surface in a rotationally adjustable manner relative thereto to allow the angle between the riser forming surface and the tread forming surface to be varied, said riser forming surface at least in part co-extending with said tread forming surface in a stair width direction, said riser forming surface including a bearing surface parallel to and distal from its said first major edge to be located against the tread defining surface, said tread defining formwork engaged to said first and second pair of rails in an adjustable manner to allow (i) their horizontal spacing to be adjusted along said rails and (ii) their angle to be varied relative to the vertical upon the movement of said first and second pair or rails vertically relative each other.

Preferably each said riser defining formwork is a discreet member that sits intermediate of two adjacent tread defining formwork and that is, for use, clampingly held therebetween, said clamping effected by the adjustment of the tread defining formwork relative said first and second pair of rails.

In yet a further aspect the present invention consists in an adjustable stair forming device, to form stairs of a settable material, each step of said stairs including a tread and a riser, wherein a landing is formed intermediate of a first and second set of steps, said device comprising or including, two moulding apparatus to each mould a set of first and second set of steps, each moulding apparatus comprising or including:

a frame, a plurality of abutting forming units to receive the settable material, each forming unit reconfigurably mounted from said frame in:

(a) a pivotal manner about an axis parallel to pivot axes of the other forming units, said axis extending in a direction parallel to the width direction of stairs to be formed, and/or (b) a translational manner in a direction perpendicular to the width direction, each of said forming units comprising, (i) a tread forming member defining a tread forming surface with an upper edge substantially parallel to a lower edge, and (ii) a riser forming member defining a riser forming surface that includes a. a first edge bearing on the tread forming member at or toward said upper edge of said tread forming member, and b. a bearing edge parallel to and distal from said first edge, said riser forming surface at least in part co-extending in said width direction with said tread forming surface, wherein prior to receiving said settable material, said forming units can be configured to a desired configuration, and wherein a first of said moulding apparatus can be configured relative to a second of said moulding apparatus to position a distal end located forming unit of said first moulding apparatus relative a distal end located forming unit of said second moulding apparatus in a manner to allow a landing forming member to span there between to allow the forming of a landing member intermediate of the set of steps defined by the first and second moulding apparatus.

In a further aspect the present invention consists in an adjustable stair moulding device adapted to form stairs, comprising or including, at least two apparatus that each include a series of adjustable forming units to act in concert to define a mould for a settable material to form the set of steps of a desired number of steps, said forming units each including a riser defining formwork and a tread defining formwork, wherein one of said riser defining formwork and tread defining formwork is part of a set of formwork, each formwork of a said set of formwork being of an identically settable configuration, a landing formwork member that can be located intermediate of the distal end located formwork units of each of said apparatus wherein said forming units are adjustably settable, including by selection of the appropriate set of formwork, to allow a setting of the following stair parameters;

tread depth, riser height, tread width, and tread protection.

In another aspect the present invention consists in an adjustable stair forming apparatus as herein described with reference to any one or more of the accompanying drawings.

In another aspect still the present invention consists in a method of using an adjustable stair moulding apparatus as herein described with reference to any one or more of the accompanying drawings.

As used here in the term "surface" can mean one continuous surface whether that surface has sharp discontinuities or bends and may be provided by two or more adjacent members.

As used herein the term "and/or" means "and" or "or", or both.

As used herein the term "(s)" following a noun includes, as might be appropriate, the singular or plural forms of that noun.

The term 'comprising' as used in this specification means 'consisting at least in part of', that is to say when interpreting statements in this specification which include that term, the features, prefaced by that term in each statement, all need to be present but other features can also be present.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

Preferred embodiments of the present invention are shown in the accompanying drawings whereby.

A preferred embodiment of the present invention will now be described with reference to FIGS. 1 through 20,

DETAILED DESCRIPTION OF THE INVENTION

Figure 20:
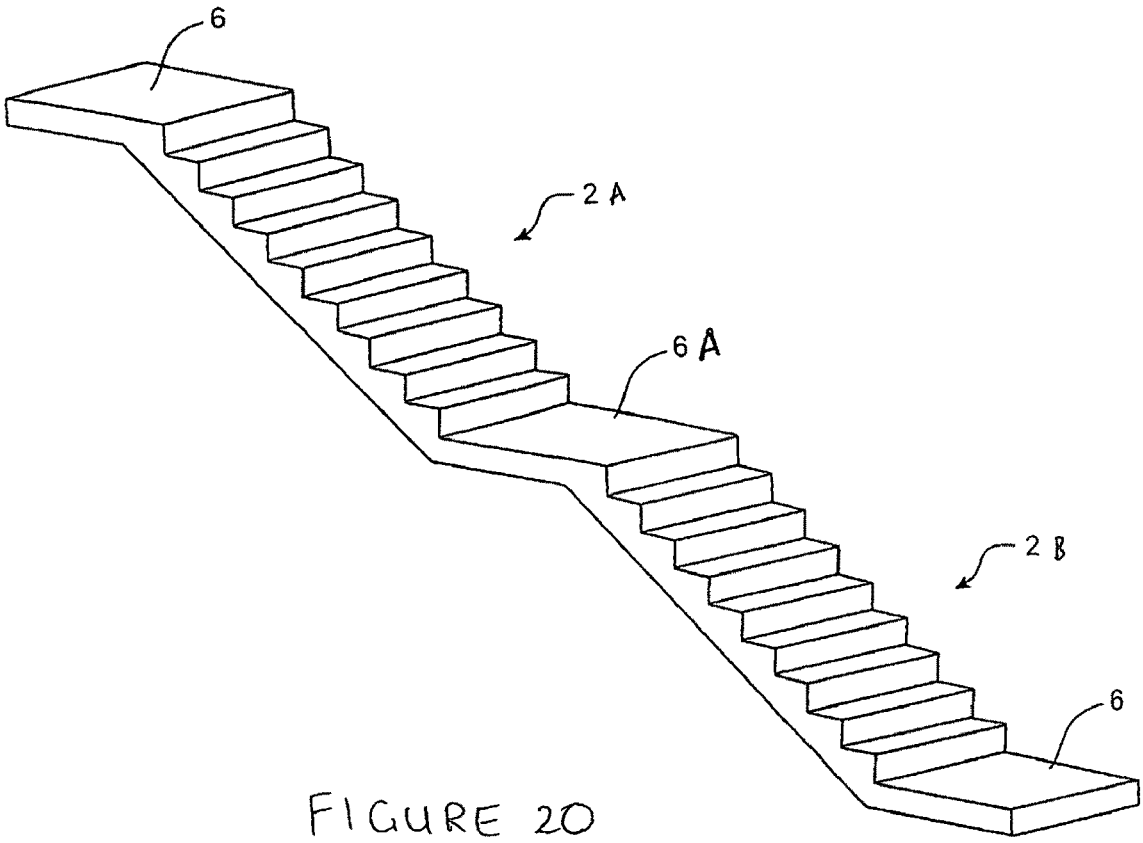
FIG. 20 shows stairs that can be formed with the present apparatus (in the particular embodiment shown there is a landing between, and moulded integrally with, two set of stairs.

A flight of stairs (2) consists of a number of stairs or steps (4). Usually also there is a landing or platform (6) at the top and/or bottom of the flight of stairs (2). The flight of stairs (2) therefore may contain only stairs (4), a number of stairs (4) with a landing (6) at the top, a number of stairs (4) with a landing (6) at the bottom, or a number of stairs (4) with a landing at the top and bottom. In additions or alternatively, a number of lower stairs (4), then a landing (6A), then a number of upper stairs (4) may be provided. Multiple intermediate landings may also be provided. There may also be a landing (6A) in the middle of a flight of stairs (2), i.e. between some upper stairs (4) and some lower stairs (4) as shown in FIG. 20.

Each individual stair (4) consists of a tread (12) and a riser (14). The tread (12) is where a person places their foot. The riser (14) is that portion of the stair that connects the tread (12) to an adjacent tread (12). The overall width (10) of the stairs (4) may be the same as the landings (6). Alternatively the width may narrower or broader depending upon the formation of the flight of stairs (2) required.

The overall height of the flight of stairs (2) is called the rise height (37) and the overall length of the stairs is called the run length (39). The ratio of rise height (37) to run length (39) is called the "rake" or "pitch". Pitch in some instances can also refer to the distance between the tips of two adjacent stairs (4). The number of steps (4) in a flight of stairs (2) is deduced by the number of risers present. Therefore in the example indicated in FIG. 1 there are three risers and therefore this is a three step (4) flight of stairs (2). The riser height is the height of any particular riser (14). The tread length or depth is the length overall of the tread.

Figure 2:
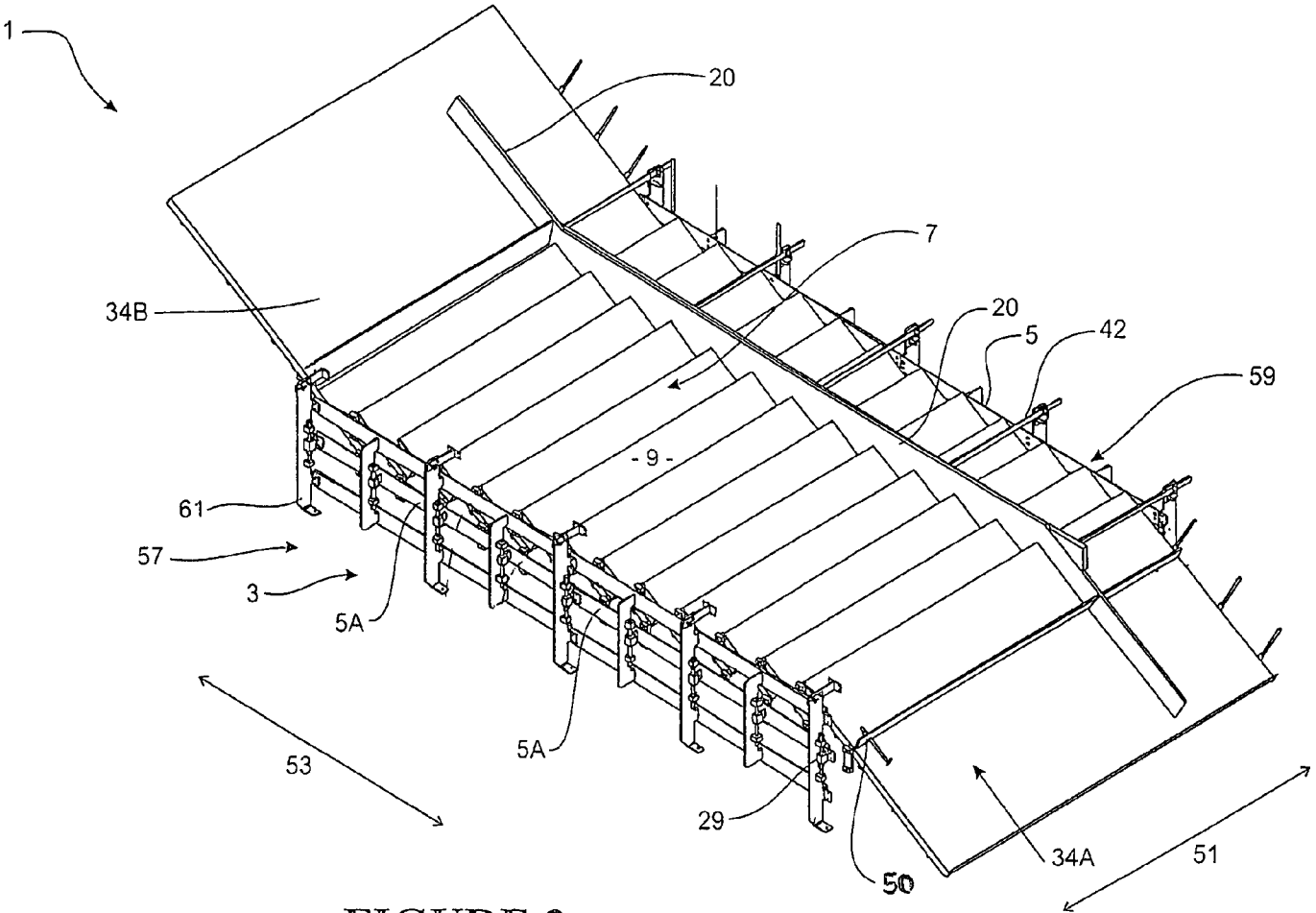
FIG. 2 shows an exemplary forming apparatus in side isometric view showing the forming surface for moulding the topside of a set of stairs including the top landing and the bottom landing.
Figure 4:
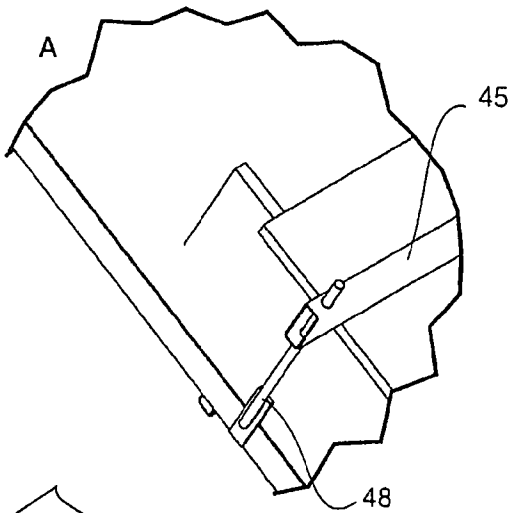
FIG. 4 shows the detail A of FIG. 3.
Figure 18:
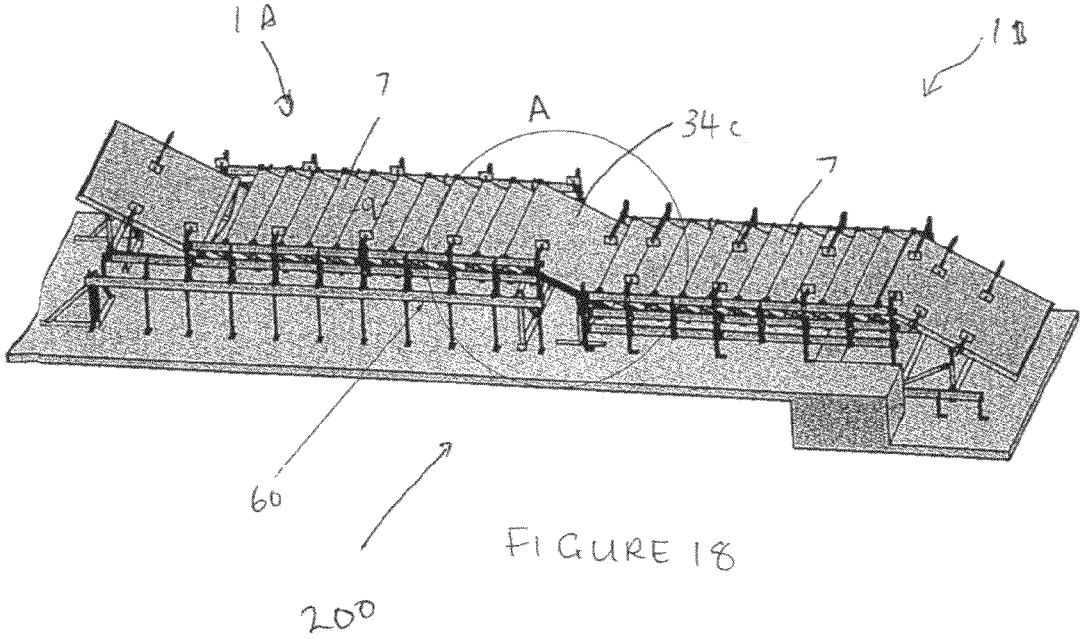
FIG. 18 shows a preferred form and setup of the stair forming device of the present invention in side isometric view showing two forming apparatus positioned relative to each other to allow the forming of the topside of a two sets of stairs and the intermediate landing.

FIG. 2 shows a preferred form of a stair moulding apparatus (1). It is to be understood that the stair moulding apparatus (1) essentially moulds a stair upside down. It receives a settable material such as concrete and once the settable material has cured it is then lifted away from the stair moulding apparatus (1). In FIG. 18 it can be seen that an appropriately placed apparatus (1A and 1B) can allow a stair moulding device (200) of the present invention to be set up for the purposes of forming an intermediate landing between two sets of stairs. It is to be understood that each forming apparatus (1A and 1B) also essentially mould upside down.

The stair moulding apparatus in this embodiment includes a frame (3). The frame consists of a first side frame (57) and a second side frame (59), each side frame having a number of frame members (5). The frame members (5) of the frame (3) sit either side of the forming units (7) and lie in a second direction (53). However in other embodiments they may sit entirely below the forming units (7), or they may be partially below and partially beside as the embodiment requires. In particular a middle frame member (5*a*) is adjustable within the frame (3).

An adjustment means (29) is located to allow adjustment of the frame member (5*a*) relative to frame (3). The embodiment shown has the adjustable frame member (5*a*) as the middle frame member. However it is to be understood that this frame member could be the lower frame member, upper frame member or possibly also the only frame member present.

The adjustment means (29) may be a threaded rod and nut. A nut running on the rod is upwardly engaged with the adjustable frame member (5*a*). In this way the thread of the adjustment means is fixed rigidly to the frame (5). The nut, is rotatable up and down on and relative to the thread. In this way the nut is rotated, moves up the thread, engages the underside of part of the adjustable frame member (5*a*) and therefore can lift the frame member (5*a*) upwards. In a similar manner when the nut is spun down the thread of the rod the adjustable frame member (5*a*) will move downwards. Other equivalents to this adjustment and other ways of achieving it will be obvious to a person skilled in the art. For example, but not limited to, a form of prime mover may be used, such as an air or hydraulic cylinder to achieve the same result.

As there is only an upward engagement of the adjustable frame member (5*a*) to the adjustment means (29) the adjustable frame member (5*a*) can be lifted up, the adjustment means set in position and then the adjustable frame member (5*a*) located downwards.

Figure 11:
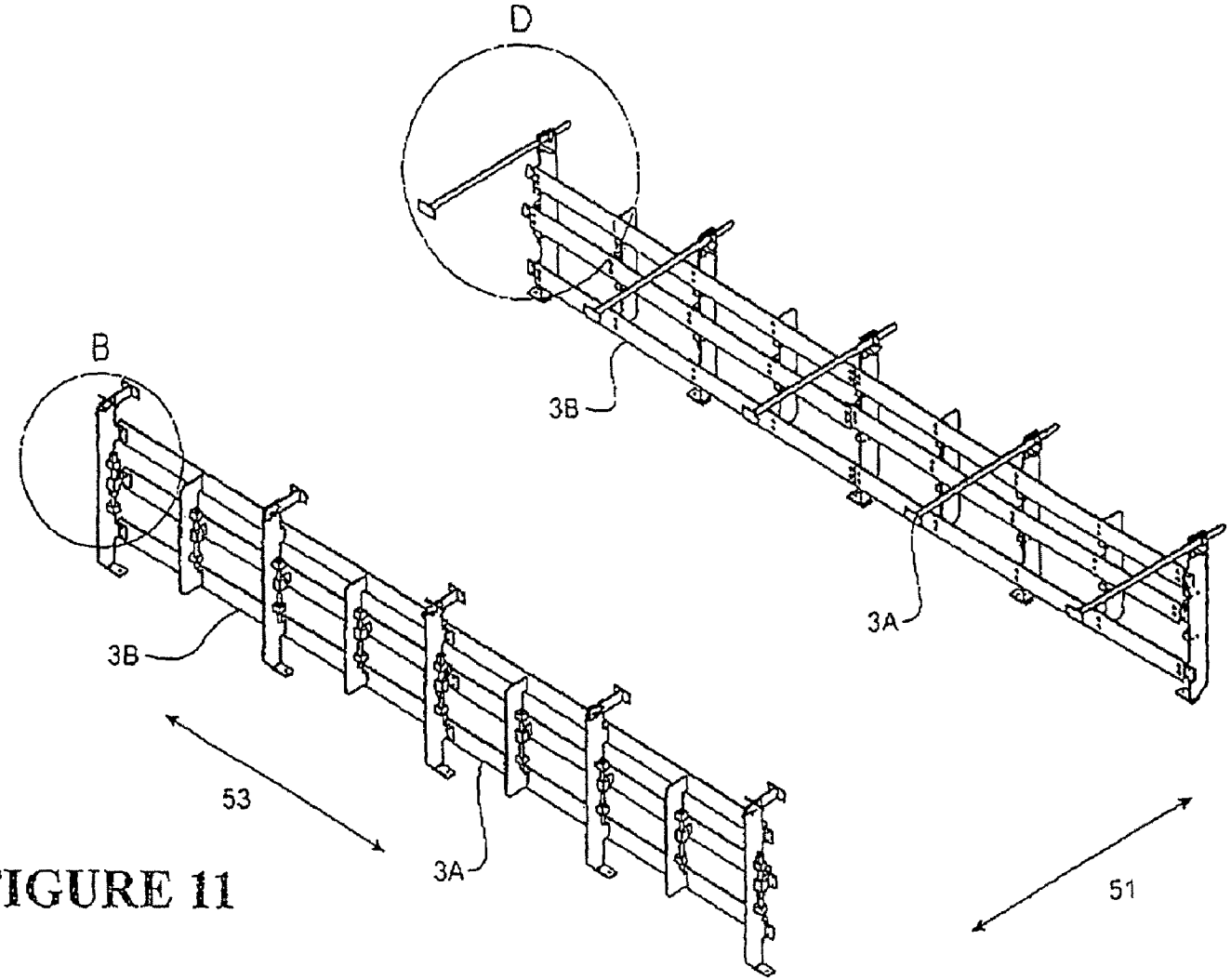
FIG. 11 shows a frame assembly for the stair forming apparatus.
Figure 12:
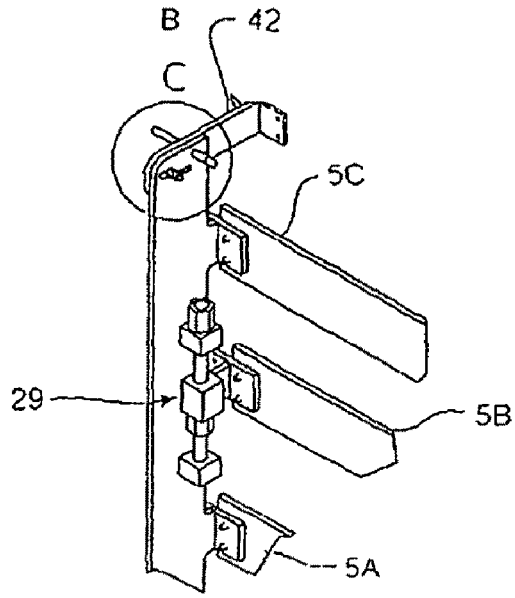
FIG. 12 shows detail B of FIG. 11.
Figure 13:
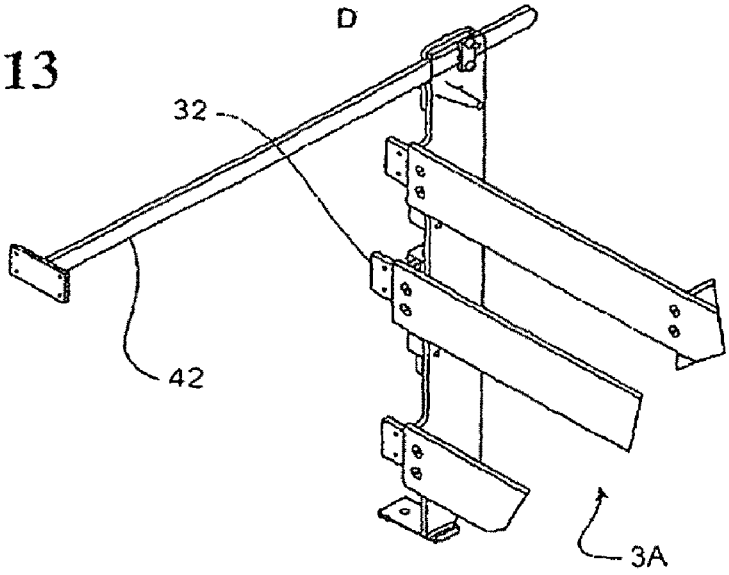
FIG. 13 shows detail D of FIG. 11.
Figure 14:
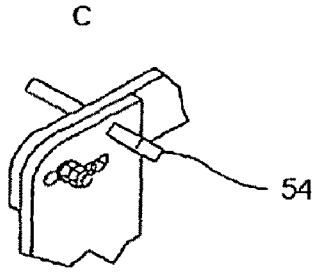
FIG. 14 shows detail C of FIG. 12.
Figure 15:
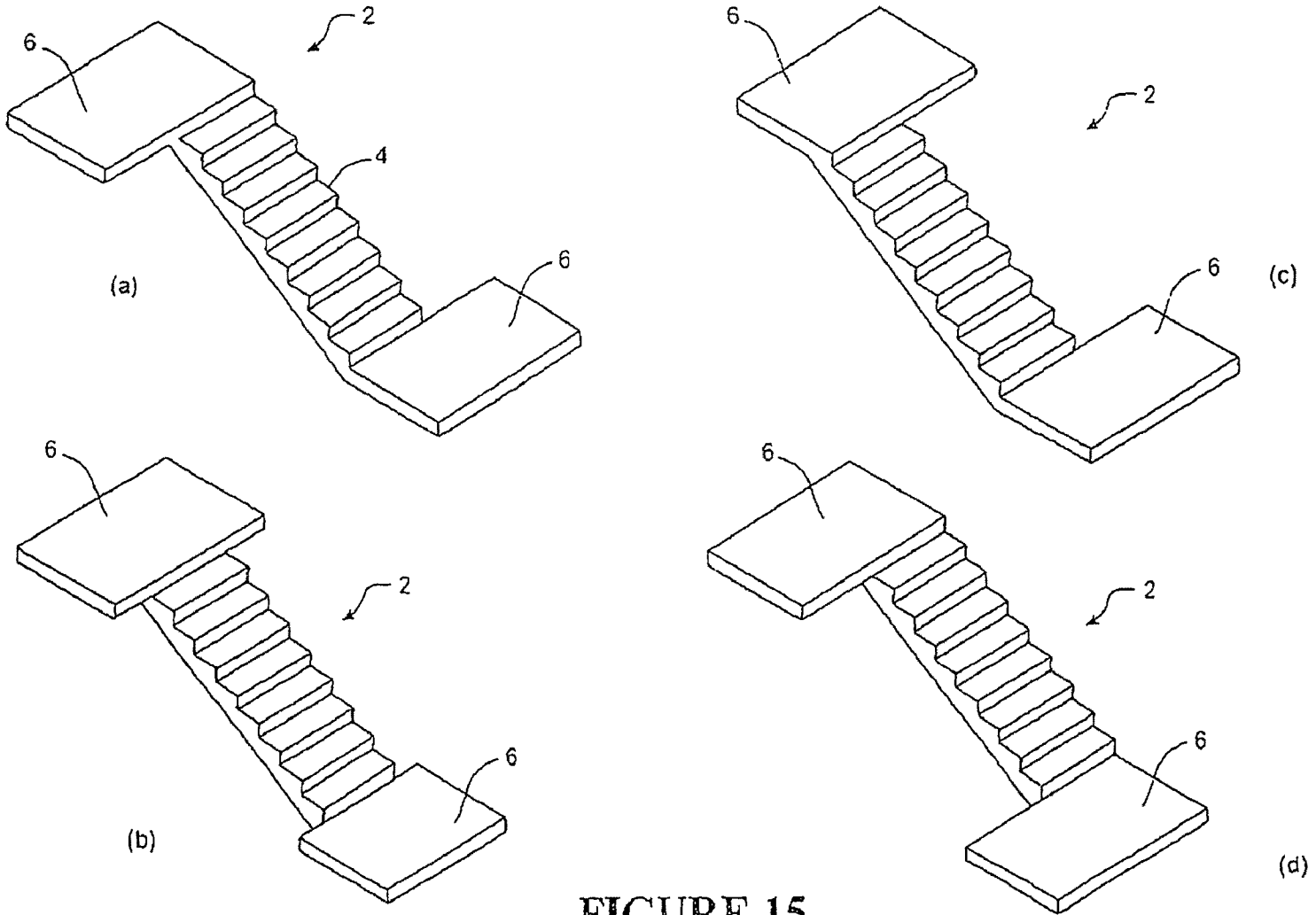
FIG. 15 shows varying forms of flights of stairs that can be formed with the present apparatus including (A) a flight of stairs with a left hand opening landing and a right hand opening landing; (B) a flight of stairs with centred landings top and bottom; (C) a flight of stairs with right hand opening landings top and bottom; (D) shows the reverse of C with the landings opening to the left top and bottom.
Figure 16:
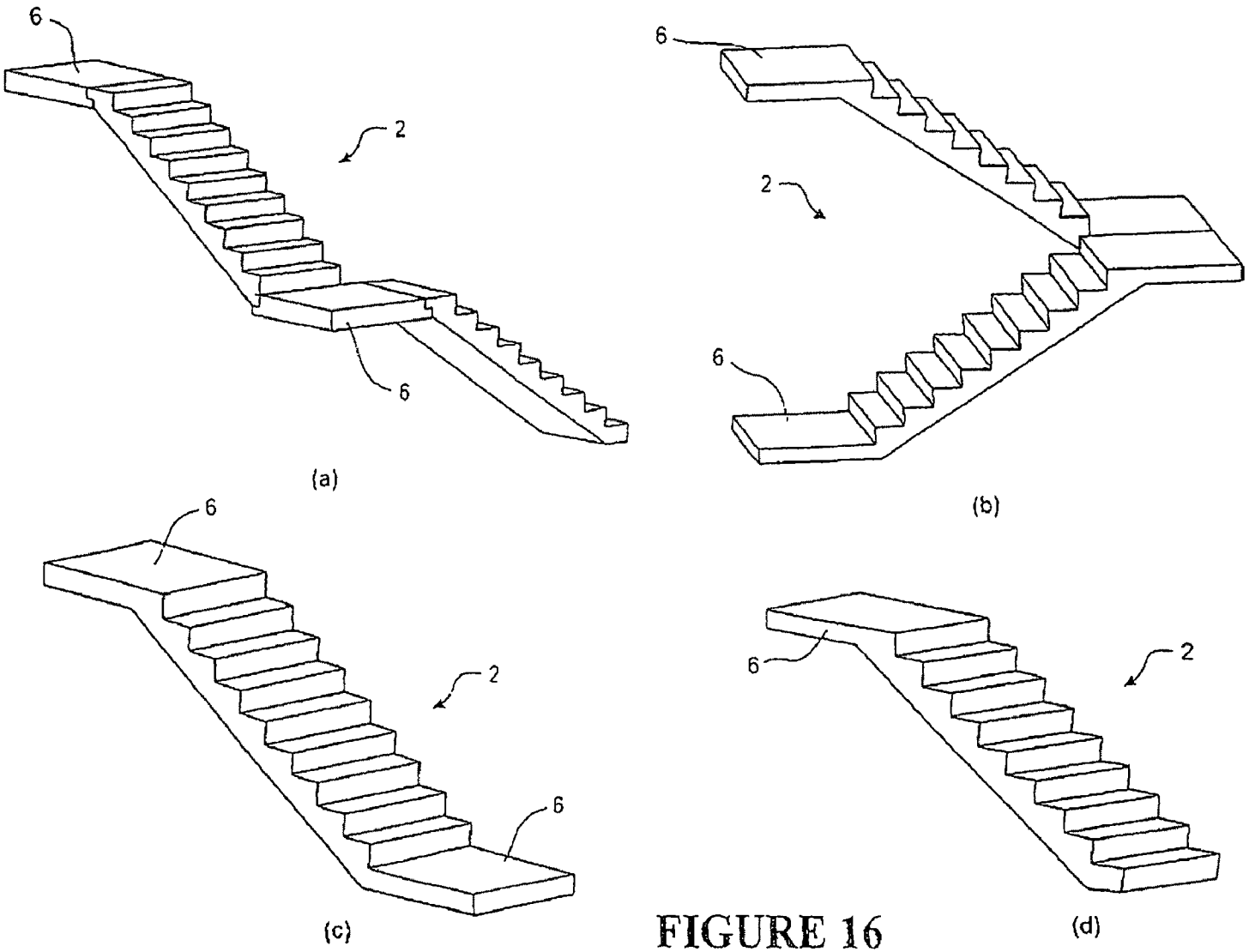
FIG. 16 shows further variations including (A) a flight that locates and abuts on separate landings top and bottom (in the particular embodiment showing the bottom landing as a right hand opening one for the flight of stairs) (B) a "U" set of stairs whereby a top landing leads to a flight of stairs with a bottom landing that communicates sideways with the top landing of a further flight of stairs moving down to a bottom landing; (C) a single flight of stairs with inline landings top and bottom (two of which reversed, forming the U shape flight shown in B); and ( ) a flight of stairs with a top landing only.

In this way also only one or two of the adjustment means (29) (e.g. at either end of the adjustable frame (5*a*)) can be moved upwards, set to the desired height and thereafter the remaining adjustment means (29) are then wound up to support the adjustable frame member (5*a*). The effect of this is discussed below. Shown in FIG. 11 is a first frame (3*a*) and a second frame (3*b*) joined together at a frame join. It is to be understood that more or less frames (3) can be added to the stair moulding apparatus (1) to enable the moulding of longer flights of stairs (2) as required. In the preferred embodiment there is an overlap or a lap available as shown in close up in FIG. 13 of the frame (3*a*) which can engage a similar complimentary lap in a subsequent frame (3*b*) to allow connection of as many frames as needed.

The frame join (32) can be seen in this instance as a lap point. Further frame members (3) are located against the lap point and fastened thereto. Fastening can be of any means known in the art. Other ways of attaching the frame members to each other are, for example sleeving, overlapping, welding if a semi-permanent fixture is required and similar.

In the preferred embodiment the frames (3) extend in the vertical plane. The members (5) of the first and second side frames (57) and (59) respectively provide reference surfaces in the horizontal direction. These reference surfaces, when at the same height on the frame, serve to define a plane.

A number of horizontal stands (61) to support the frame members (5) are bolted or attached to a flat horizontal member such as a floor of the moulding room. The frame (3) then supports the plurality of forming units (7) via the frame members (5) in a way that will now be described.

It is shown that the frame (3) consists of first and second side frames (57) and (59) that lay either side of a plurality or series of forming units (7).

For each apparatus (1A or 1B) as shown in FIG. 18 a number of horizontal stands (61) to support the frame members (5) are bolted or attached to a flat horizontal member such as a floor of a moulding room. The frame (3) then supports the plurality of forming units (7) via the frame members (5). The apparatus 1A may be positioned at a different level to that of apparatus 1B.

For each apparatus (1A and 1B) the frame (3) consists of first and second side frames (57) and (59) that lay either side of a plurality or series of forming units (7).

An individual forming unit (7) has a tread forming member (78) that defines a tread forming surface (11) and a riser forming member (76) that defines a riser forming surface (13). The tread forming member in one embodiment is pivotable at its lower edge (19) by a lower edge bracket (43). Pivoting is about a first axis that extends in a first direction (51) that joins between and is perpendicular to each of the side frames, i.e. the transverse direction.

Where the term "width" is used it is to be understood to be transverse to the flight or second direction (53), i.e. in the first direction (51). "Length" is parallel with the frames (5), i.e. in the second direction (53). Height is a term indicating relative distance perpendicular from one tread forming surface to the next tread forming surface. In this context height also refers to the vertical height of a stair when in location on a building.

In the embodiment shown the lower edge bracket (43) is C shaped in cross section and engages the inside of a frame member (5) and hooks around the top and bottom surfaces of the frame member (5). In this way the lower edge bracket (43) is slidably engaged along the frame member (5) that it is attached to. In the preferred embodiment this frame member is the adjustable middle frame member (5*a*).

In the embodiment shown the lower edge (19) of the tread forming surface (11) is pivotally engaged with the lower edge bracket (43). The pivoting in this case is on a second axis, parallel to the first axis, these are therefore two parallel axes. The forming unit (7) can pivot relative to, and can also slide relative in the second direction (53) on the frame. The second direction is perpendicular to the width direction and parallel to the longitudinal axis of the frame (3) and frame members (5). The second direction is the direction parallel to the pitch line of the stairs, i.e. that line that connects the tips of the tread forming surfaces.

Each tread forming member (78) as shown may be made from four millimeter thick steel plate. However any thickness of any particular material may suffice. If the material itself is not strong enough in bending then structural beams (45) (for example shown in FIG. 9) can be used to strengthen and stiffen the transverse stiffness of the tread forming surface (11). The tread forming surface also has structural sides (47) that reinforce the edge of the tread forming surface (11).

Therefore, practically any width of tread forming surface can be used and it is only dependent upon the stiffness that can be achieved. The greater the width and/or length of the tread forming surface (11) the greater the number and strength of structural means (45) that can be applied. Therefore it is entirely possible that the current apparatus may find application outside the field of forming of stairs, for example forming grandstand seating or similar.

Figure 1A:
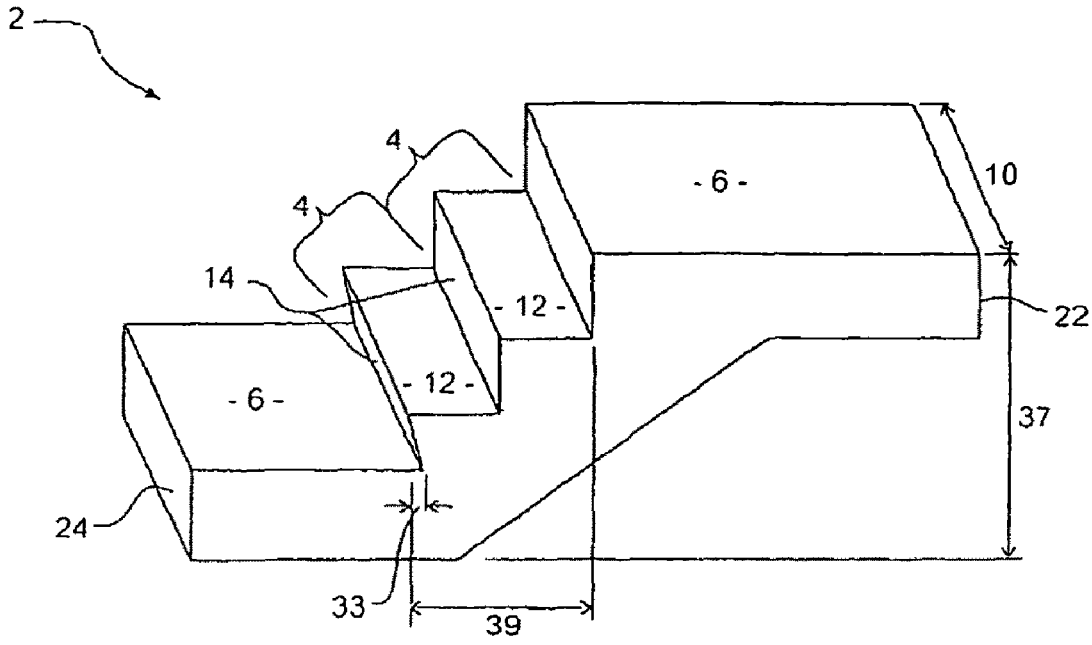
FIG. 1 shows at (A) an indicative flight of stairs in side perspective view showing landings and stairs there between, and at (B) a variation whereby the nosing is at an obtuse angle.
Figure 1B:
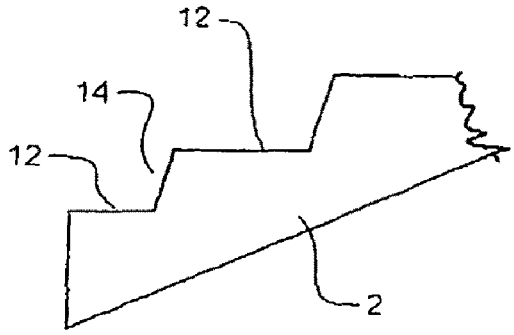
Figure 8:
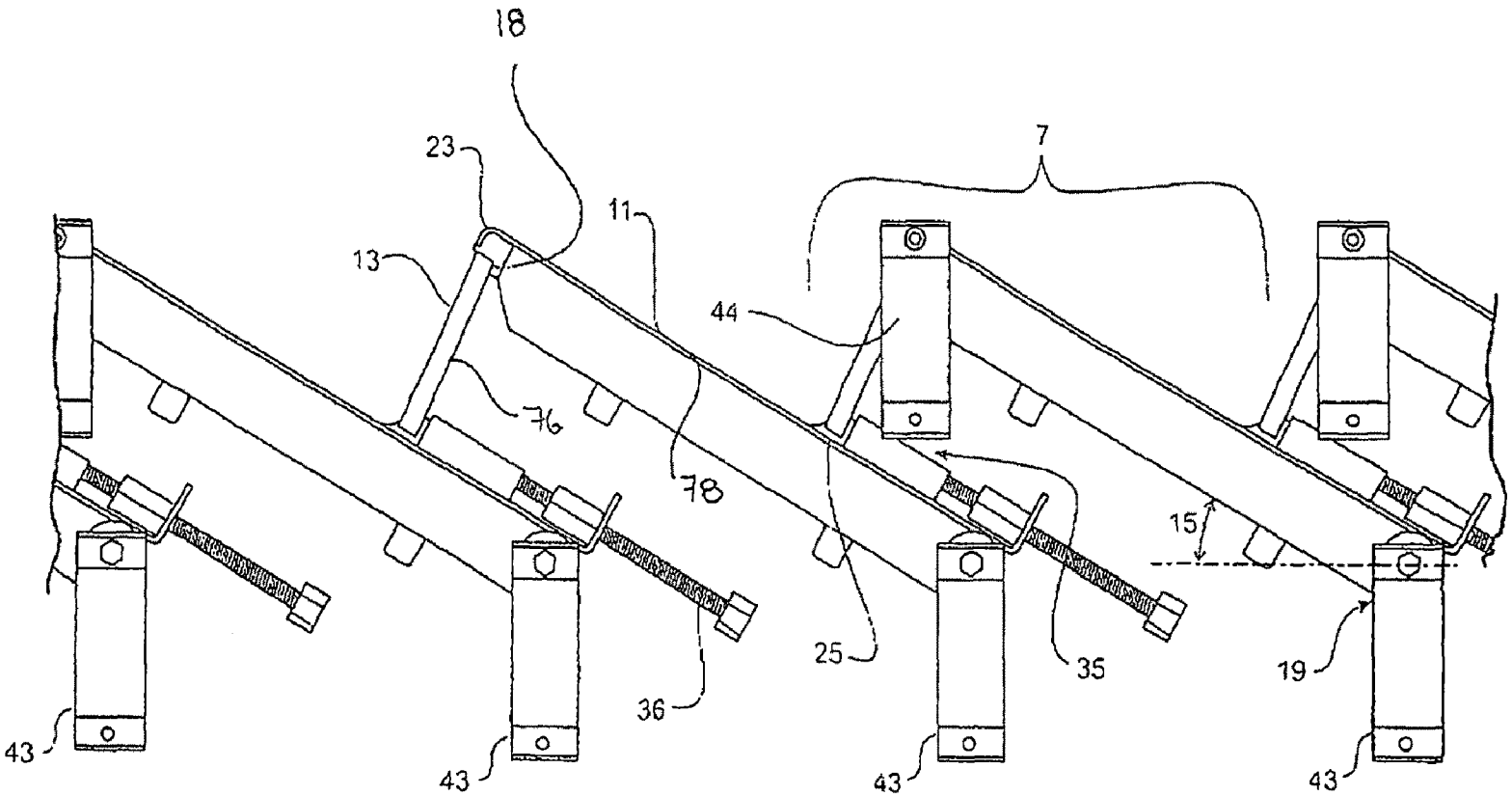
FIG. 8 shows a close up side profile of a series of forming units, and the pivot points and backside for sliding on various frame members.
Figure 9:
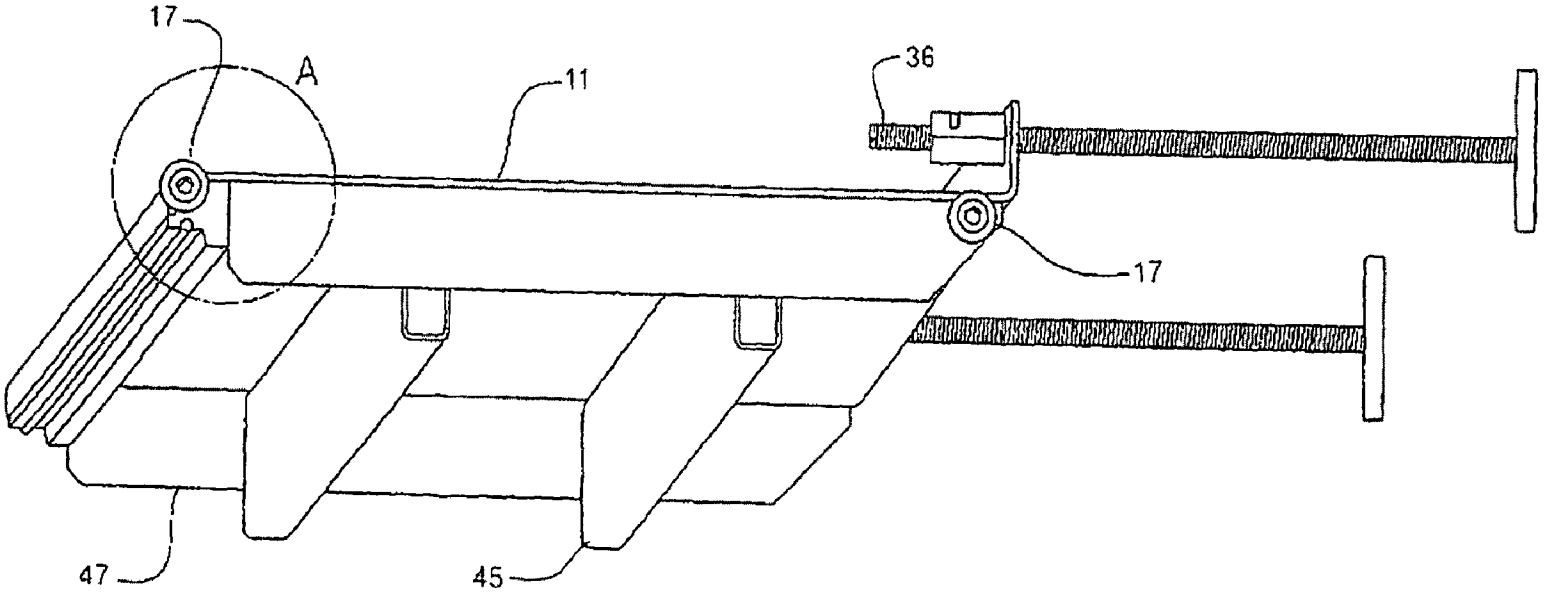
FIG. 9 shows a bottom isometric view of the tread forming surface.

Located from the distal edge (23) of a tread forming surface (11) is a riser forming member (76) with the riser forming surface (13) thereon. The riser forming surface (13) is or can be adjustably mounted from the distal edge (23). This is to accommodate the riser forming surface (13) being at 90° to the tread forming surface (11) and also to jut forward at a positive angle as seen in FIG. 8 or to angle backwards relative to the tread forming surface (11). When angled backwards at an acute angle (i.e. toward the lower edge (19)) this creates a nosing (33) of the stair tread. It may also be desirable to have the riser forming surface (13) angled forwards at an obtuse angle relative the tread forming surface (11), to form a riser as shown in FIG. 1*b*.

Figure 17:
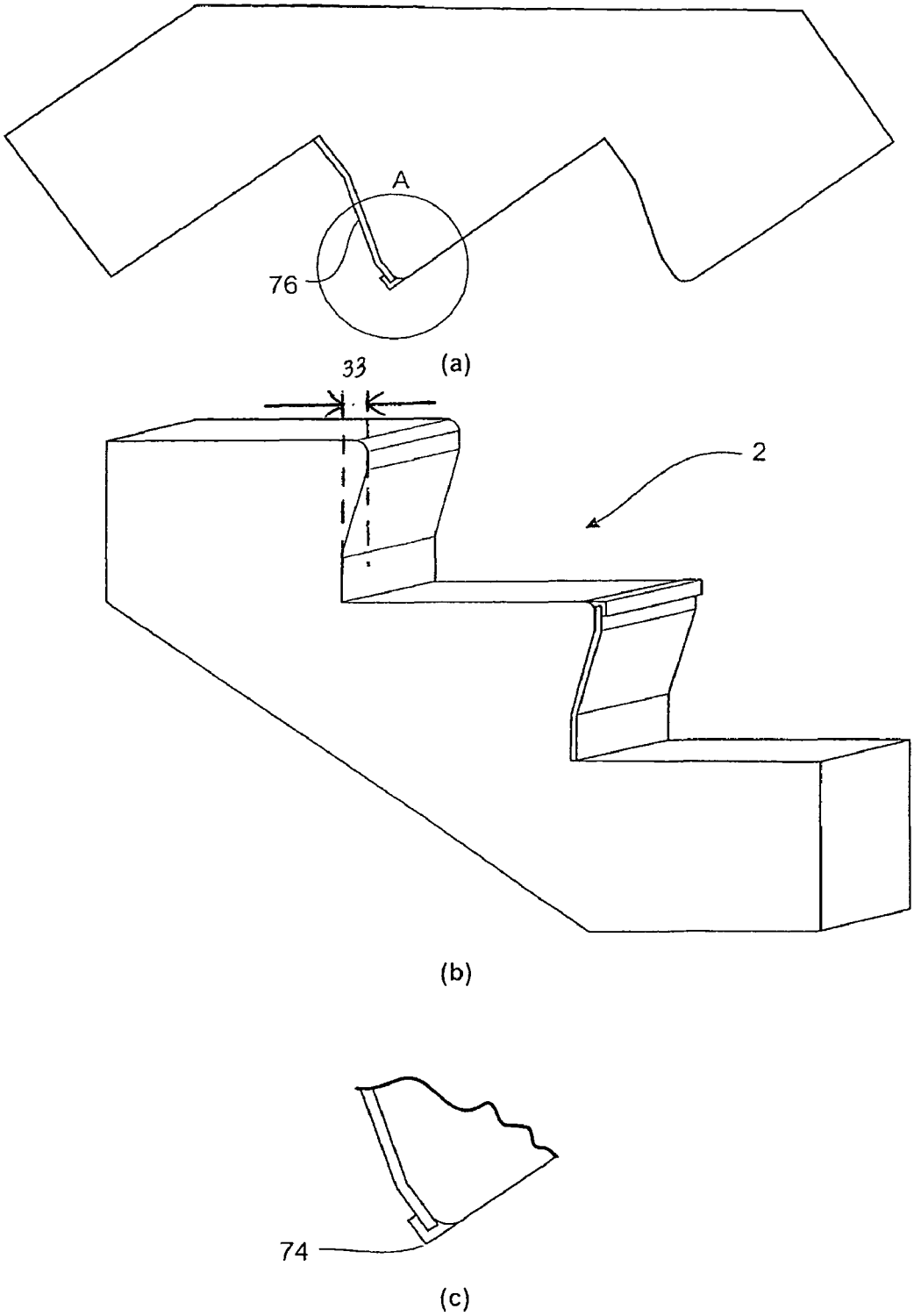
FIG. 17 shows a further stair shape and tread former for forming the stair shape.

The riser forming member (76) can have any form of cross section needed. For example FIG. 17 shows a riser forming member (76) that has a nosing (33) formed due to its facetted or composite surface "S" form shape. Different height and width riser forming surfaces (13) can also be used as needed for various stair flights formed. In addition any of the surfaces described may be made of multiple parts that present a surface or composite surface.

In addition if needed inserts (74) can be applied to the mould, for example protection for the leading edge of the tread. Such protection strips are known in the art and may simply protect the edge of the formed step from chipping, may add grip, or may have a cushioned region so that a person falling or hitting the step leading edge is likely to be less injured. Insert (74) may also be removable to leave the radiused edge shown in FIGS. 17*a* and *b*, such as a 5 to 10 mm radius. A similar edge form can be created by the curved mould cavity presenting surface of bearing surface 25 as shown in FIG. 8 for example.

Nosing (33) is also referred to hooking or overlapping. It is the distance that one tread length under laps a next tread length above it. Nosing is also referred to as tread protection in the trade. In trade "nosing" may also refer to the edge between a tread and riser that presents itself outwardly (and may be formed by element 25 or 74 as herein described) However as used herein "nosing" is generally not in reference to such trade use of the word.

Figure 10:
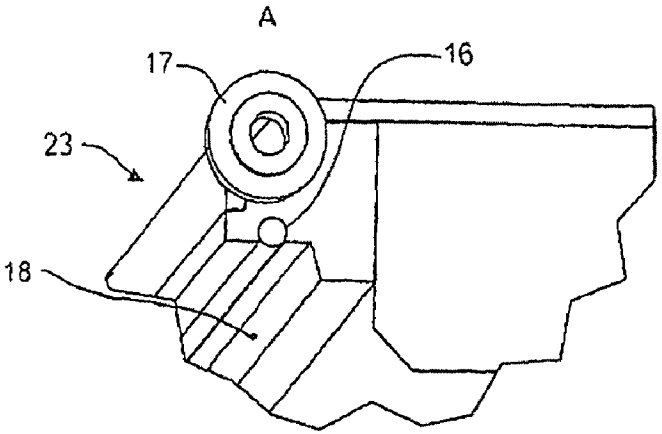
FIG. 10 shows detail A of FIG. 9.

FIG. 10 shows detail of the distal edge (23) showing a further pivotal mounting point (17) and a seal (16). In practice the riser forming surface (13) can be any formed by stiff resilient material. For example, wood, medium density fibreboard, steel, aluminium or similar may be used. In the preferred embodiment a wood material is used. In another preferred embodiment it is made from 6 mm thick plate steel.

The riser forming member (76) butts against a resistant edge (18) of the distal edge (23) as shown in FIG. 10. Therefore the weight of the settable material once located in the stair moulding apparatus (1) will bear against the riser forming surface (13) and push the riser forming member (76) against the resistant edge (18) and/or seal (16).

Present also is an adjustable stop (35) and its adjustment means as a back stop adjuster (36). The adjustable stop (35) butts up against the backside of the riser forming member (76) to prevent its movement inward (to the right when viewed in FIG. 8).

Therefore the nosing (33) of one thread relative to another can be adjusted by relative positioning of the backstop (35). In the particular embodiment shown the backstop (35) is a rectangular hollow section that is supported by a threaded back stop adjuster (36) as shown in FIG. 8. The back stop adjuster (36) consists of a threaded rod that is thread wise engaged with a nut that sits on the upside of a return surface of the tread forming surface (11) as shown. Winding the thread will cause the back stop (35) to move up or down the tread forming surface (35). Therefore tightening of the nut against the return of the tread forming surface (11) pushes the adjustable stop (35) against the backside of the riser forming surface (13). Other means to effect this movement will be apparent to those skilled in the art. For example hydraulic, air or lever mechanisms may be used.

The backstop (35) runs for most of, and in the preferred embodiment all of, the width of the riser forming surface (13).

The sliding bracket of the lower edge bracket (43) and upper edge bracket (44) allows adjustment of the pitch of the resulting flight of stairs (2). Additionally it allows easy removal of forming units (7) by sliding off the frame members (5). Therefore if stairs need to be formed with only ten steps but a set of fourteen forming units (7), are supplied, then four can be removed to form a ten step flight of stairs (2). If additional stairs also need to be added then additional forming units (7) can be added to increase the number of stairs in a flight of stairs (2).

A single forming unit (7) that defines upper tread forming surface (11) and riser forming surface (13) can be pivoted at or toward its lower edge (19) of the tread forming surface from a lower edge bracket (43) and pivoted from a distal edge (23) by an upper edge bracket (44). Preferably distal edge (23) is parallel to the lower edge (19). As described, each bracket can also slide on its respective frame member (5) and (5*a*).

A bearing surface (25) is present on the lower most edge of the riser forming surface (13). This bearing surface (25) bears on the tread forming surface (11) of an adjacent forming unit (7). In the preferred embodiment this bearing surface (25) is a compressible material so that under compressive loading it will form a seal to resist the egress of any settable material between the riser forming surface (13) and the tread forming surface (11) on which it bears. Similarly there is a seal (16) at the interface between the upper most edge of the riser forming surface (13) and the distal edge (23). However in other embodiments no seal need be present.

When the side mould surface (20) is located within the width of the stair moulding apparatus (1) then adjustable side brackets (42) can extend from the frame (3) at regular intervals thereon to support the side mould surface (20). In the embodiment shown they extend from the right hand side of the frame (3). They could just as easily extend from the left hand side or from both sides.

When a landing (6), either at the head or bottom of the flight of stairs (2), is to be formed then landing surfaces (34) are located in place. These landing surfaces ((34*a*) for the bottom landing surface and (34*b*) for the head landing surface) are adjustable in angle relative to the frame. This is so that they can accommodate variable pitches of flights of stairs (2). The landing surfaces (34) form the upper presenting surface of the landing (6) for the flight of stairs (2) when oriented for use. Because the landings (6) must have some thickness, additional landing surfaces (46) are located parallel to (in the preferred embodiment) and above the landing surfaces (34). The additional landing surfaces (46) act to form a cavity or void to receive the settable material.

The frame (3) and forming units (7) are generally laid horizontally; therefore the forming surfaces for the landings (6) are at an angle thereto. The bottom landing forming surface (34*a*) angles downward, and the head landing forming surface (34*b*) angles upward, relative to the frame (3). Without these additional landing surfaces (46) the settle material could not easily be formed at an angle to the horizontal.

When using a settable material such as concrete or similar it is often vibrated into position to remove air that may be present. The weight of the settable material combined with this vibration action creates significant stress on parts of the apparatus. Additional reinforcing, in the form of structural beams (45) may be located wherever there is insufficient bending strength in any of the forming surfaces to counteract the weight of the settable material combined with the additional loading vibration to remove air pockets creates.

Figure 3:
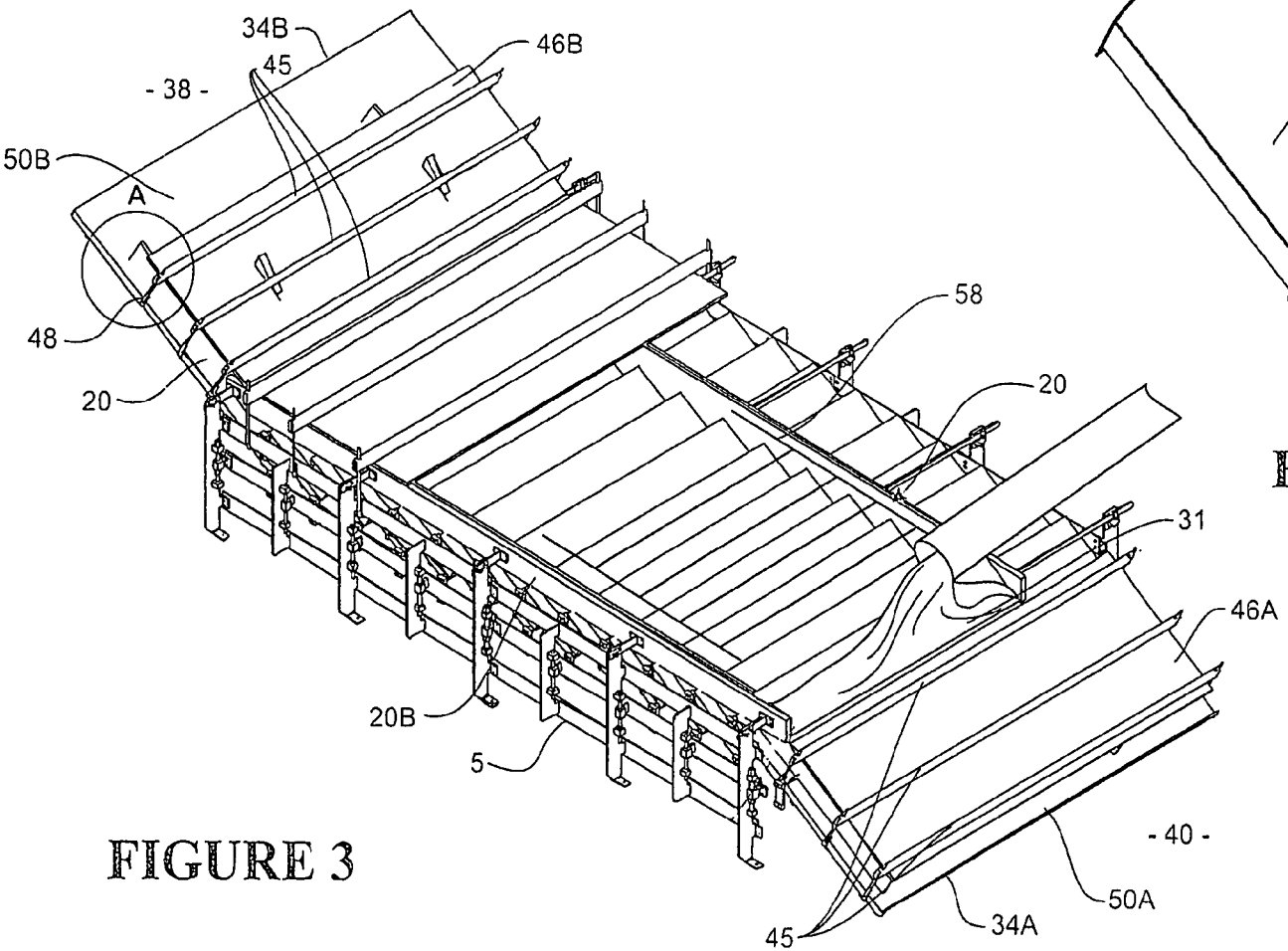
FIG. 3 shows a further view of the apparatus in the FIG. 2 with the addition of top plates located for landing moulding.
Figure 5:
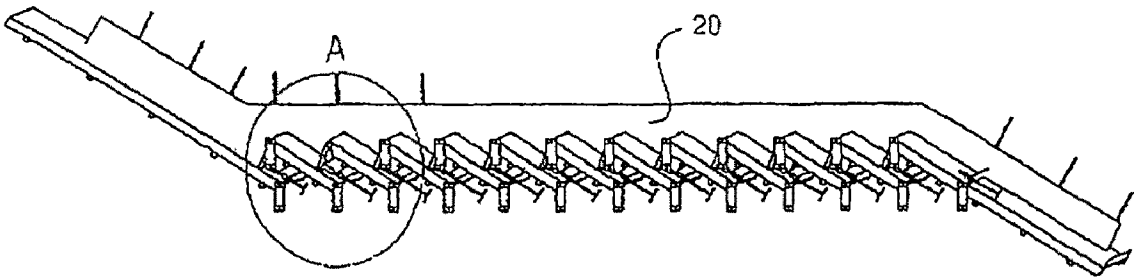
FIG. 5 shows in close up the side view of the stair forming apparatus of FIG. 2.
Figure 7:
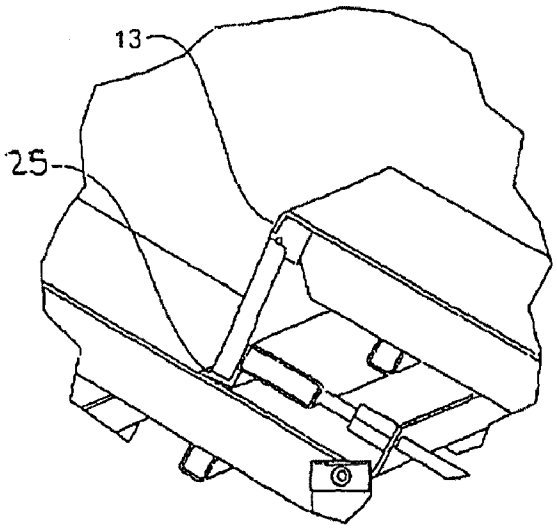
FIG. 7 shows detail B of FIG. 6.
Figure 6:
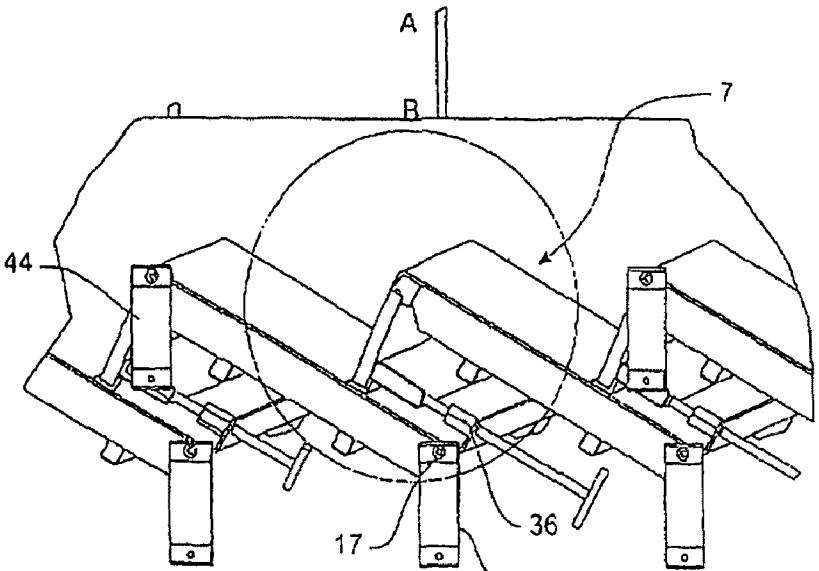
FIG. 6 shows detail A of FIG. 5.

In FIG. 3 the additional landing surfaces (46*a*) and (46*b*) have structural beams (45) located across their tops. These beams may attach by clamps (48) to the underside of the landing surfaces (34*a*) and (34*b*). Again the structural beams (45) in this instance are of rectangular hollow section of cross section to impart the required strength.

In the preferred embodiment the threaded member used is threaded reinforcing bar. This material is generally available in such manufacturing operations, settable material normally easily breaks off it, and if damaged at all the threaded member can easily and cheaply be replaced.

At the very end of the bottom landing forming cavity (comprised of bottom landing surface (34*a*), side moulding surfaces (20) and additional landing surface (46*a*)) is located a cavity closing surface (50A). This ensures that the cavity for forming the bottom landing is only open upwards towards the main part of the stair forming apparatus (1).

Figure 19:
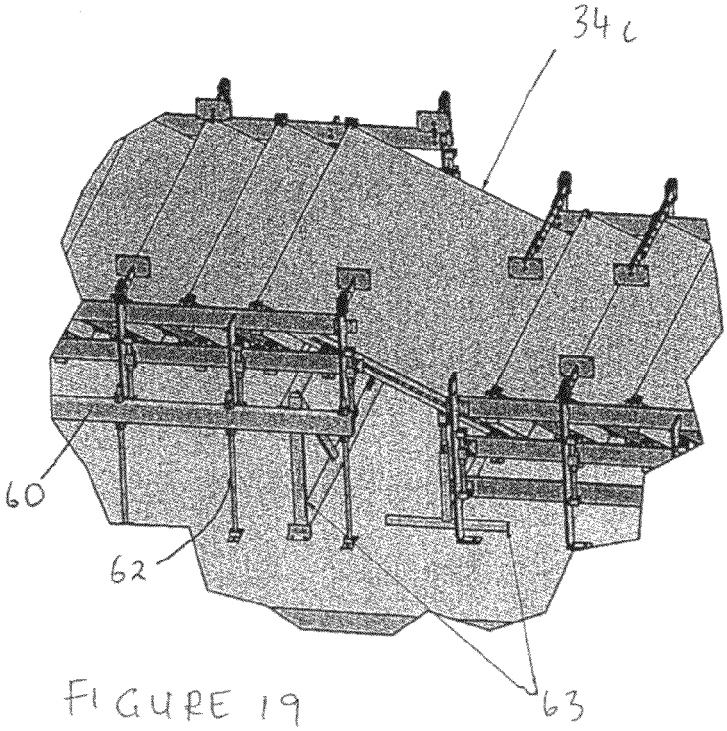
FIG. 19 shows a close up view of the area 'A' of FIG. 18 showing the landing surface for the intermediate landing.

FIGS. 18 and 19 show the preferred form of a stair moulding device (200) of the present invention where intermediate landings can be formed. The stair moulding device includes the apparatus (1A) and (1B) as herein before described, utilised in a manner suitable for moulding flights of stairs that have an intermediate landing (6A) as shown in FIG. 20. Moulding a flight of stairs with an intermediate landing (6A) may be accomplished by having a landing forming surface (34*c*) set up between the apparatus (1A) and (1B). In this way, a landing (6A) can be moulded integrally with the flights of stairs. The flights of stairs may also have top and bottom landings (6) in addition to the intermediate landing (6A).

Apparatus (1A) may have a support beam (60) located on the first and second side frames (57) and (59). The support beam (60) of each side frame (57) and (59) may be adjustable so that it can be raised or lowered as required. Raising or lowering the support beam (60) effectively raises or lowers the entire forming surface (9) of the apparatus (1A).

There is preferably a support beam adjust means (62) for adjusting the height of the support beams (60). The support beam adjustment means (62) may be a threaded rod and nut. A nut running on the rod may upwardly engage with the support beam (60). The nut may be rotatable up and down on and relative to the thread. In this way, as the nut is rotated, it may move up the thread, and engages the underside of the support beam (60) and can therefore lift the support beam upwards. In a similar manner when the nut is spun down the thread of the rod, the support beam (60) will move downwards. Other equivalents to this adjustment and other ways of achieving it will be obvious to a person skilled in the art. For example, but not limited to, a form of prime mover may be used, such as an air or hydraulic cylinder to achieve the same result.

Moving (up or down) one of the apparatus (1A or 1B) relative the other allows for an intermediate landing forming surface (34*c*) to be appropriately located.

There may be provided temporary supports (63) to support the intermediate landing forming surface (34*c*). The supports (63) may be removed when moulding stairs without central landings (i.e. when the rear and front sections of the stair moulding apparatus (1) are at the same height).

It should be noted that by moving the apparatus (1A or 1B) up or down and changing the overlap distance of the tread plates (7) the effective length of the intermediate landing can be changed.

It should be appreciated that there may be more than one intermediate landing surface (34*c*) provide. In such a configuration, a plurality of stair moulding apparatus (1) would be (provided each are able to be) raised or lowered relative the adjacent apparatus (1), thereby allowing a intermediate landing forming surface (34*c*) to be located between each apparatus. The flight of stairs created by such a moulding device would therefore have more than one intermediate landing between each set or flight of stairs.

FIG. 20 shows an example of a flight of stairs that may be moulded. The example has an intermediate landing (6A), moulded integrally with an upper flight of stairs (2A) and a lower flight of stairs (2B). There may also optionally be top and bottom landings (6).

The method of use of the apparatus will now be described with reference to the apparatus described in FIGS. 1 to 17.

The lower edge brackets (43) and upper edge brackets (44) as earlier described are slidably engaged to the frame members (5).

In use the desired stair pitch (i.e. spacing along the pitch line of the stairs of one stair nose to the next stair nose) is set up by sliding the forming units (7) to the required pitch distance. This can be done in several ways. The profiled side mould surface (20) when cut to the correct pitch shape can be used as a guide to set the forming unit (7) pitch. In other ways it can be measured by hand, or a set up jig can be used, or other measuring means on the frame (3) can be used.

The approximate pitch of the forming units (7) is then set. The incline angle (15) of the tread forming surface (11) to the frame (3) is then set globally for the steps (4) in the flight of stairs (2). In the preferred embodiment this incline angle (15) is initially set to the approximate angle. This can be done in one of several ways. First the relative height of the adjustable frame member (5*a*), in this case to the frame member (5*b*) above it, can be adjusted in the way described. This sets the relative angle (15) of the forming units. As the adjustable frame member (5*a*) is raised it reduces the relative incline angle (15) of the tread forming surface (11) the frame members (5) that in this case lie parallel to the horizontal direction. As the adjustable frame member is lowered the opposite occurs. In other embodiments it may be the frame member that is pivotally and slidably attached to the upper edge (23) that may be adjustable. In this case the opposite movements cause increase and decrease of the relative angle (15). A person skilled in the art will understand such equivalence.

In other ways for example if the distal edge (25) of the tread forming surface (11) is not pivotally connected to a frame member it can be set by the relative height of the riser forming surfaces (13). In further alternatives the lower edge may be simply supported. This simple support may move up and down to effect change in the incline angle (15). Alternatively the simple support may be stationary, at least in the vertical direction and the upper edge (23) may be adjustable, as described to change the incline angle (15). Other equivalents will be apparent to a person skilled in the art.

Once the stair pitch and relative angle are approximately set for the tread forming surface (11) if not already in place the riser forming surfaces (13) are located therein. In the preferred embodiment the riser forming surfaces (13) are located in place after the approximate angle of the tread forming surfaces (11) are set. The subsequent setting of the correct angle of the tread forming surfaces (11) then clamps the riser forming surfaces (13) in place. These bear upon a resistant edge (18) located at the interface of the riser forming member (76) with the distal edge (23) of one tread forming surface and the adjustable stop (35) of the adjacent tread forming surface (11). If required the nosing (33) is set for each of the riser forming surfaces (13) by adjusting the adjustable stop (35) by changing its backstop adjuster (36) as previously described. Thereafter if not already in place the side mould surfaces (20) are located on the forming surface (9). If required the lower, upper and side surfaces for forming the landing or platform (6) are then also located at the head (38) or bottom (40) or both and angled at the desired inclination.

Thus the stair forming apparatus (1) can adjust the number of stairs (4) to be formed, the height of the stair riser (14), the depth of the tread (12), including any overlap or nosing (33), the width of the stairs, the angle of the stairs and if present the size of any landing (6)

Where extra bracing of any forming surface is required these can then be put in place.

If any reinforcing (58) for the flight of stairs is required (2) this is then located into the stair moulding apparatus cavity that is now formed. Thereafter settable material (31) is located in the cavity and may be vibrated into place. Once the bottom landing cavity has been filled and the main stair cavity has been filled then the additional landing surface (46*b*) for the head landing (if present and required) is located in the place and settle material is located in that final void. Thereafter a cavity closing surface (50*b*) is located to close of the head landing cavity.

If required any lifting rings or connections points are located in the settable material before it cures. Alternatively these may be attached to any reinforcing prior to pouring of the settable material.

Once the settable material has set the resulting form from the stair moulding apparatus (1) can be removed. In order to do this it is preferable if some of the forming surfaces are loosened from the cured settable material. The side mould surfaces (20) can be freed in the following way. The side brackets (42), whether adjustable or not, are held in place by a bracket wedge (54). This holds the side mould surfaces in place. When the bracket wedge is not present there is a degree of lateral play (e.g. 10-15 mm) transverse to the mould. However after the settable material has cured the side mould surface (20) has very likely adhered to the cured material. When the wedge is removed, reversed and located back into place a sharp tap of the bracket wedge will drive the side brackets (42) away from the cured settable material. This will in turn break the adhesion between the cured settable material and the side mould surface.

The tread forming surfaces (11) and riser forming surfaces (13) can also be moved relative to the cured settable material to help release the flight of stairs. The adjustable stops can be loosened and/or the tread forming surfaces moved away from the tread surfaces of the stair flight they have formed.

If further forming surfaces need to be freed from the cured settable material that can be done by tapping with a hammer or other ways known in the art. Also the stair moulding apparatus may be actuated to rack it away from the cured settable material.

What we claim is:

1. An adjustable stair forming apparatus, to form, in an inverted condition, a flight of stairs of a settable material, each stair of said flight including a tread and a riser, each having a width, said apparatus comprising;

a frame, a plurality of abutting forming units to receive the settable material, each forming unit reconfigurably mounted from said frame in:

(a) a pivotal manner about a first axis parallel to pivot axes of the other forming units, said axis extending in a direction parallel to the width direction of the flight of stairs to be formed, and (b) a translational manner in a direction perpendicular to the width direction, each of said forming units comprising;

(i) a tread forming member defining a tread forming surface with an upper edge, and (ii) a riser forming member defining a riser forming surface of a fixed shape and that includes a. a first edge bearing on the tread forming member at or toward said upper edge of said tread forming member, and b. a bearing edge parallel to and distal from said first edge, said riser forming surface at least in part co-extending in said width direction with said tread forming surface, said plurality of forming units each arranged relative said frame with said bearing edge of one said forming unit located by an adjustable support at said tread forming surface of an adjacent said forming unit, adjustment of said support rotationally positioning said riser forming member relative said tread forming member to allow an angle between said riser forming surface and said tread forming surface to be varied to set a desired amount of tread protection, wherein prior to receiving said settable material, said forming units can be configured to a desired configuration, adjustment of said forming units relative each other allowing forming of differently shaped flights of stairs.

2. The adjustable stair forming apparatus as claimed in claim 1 wherein each said tread forming member is rotatably mounted about a respective first axis to said frame at a location distal and below the upper edge of said tread forming member.

3. The adjustable stair forming apparatus as claimed in claim 1 wherein said forming units act in concert to collectively provide a forming surface.

4. The adjustable stair forming apparatus as claimed in claim 1 wherein a direction perpendicular to the width direction is in the flight or pitch line first direction of said flight of stairs.

5. The adjustable stair forming apparatus as claimed in claim 1 wherein said tread protection can be set by adjustment of the adjustable support means by which the riser forming member is located at said tread forming member of an adjacent forming unit, said adjustment moving the support means over the tread forming surface of an adjacent said forming unit.

6. The adjustable stair forming apparatus as claimed in claim 1 wherein the number of stairs to be formed is adjusted by removing or adding one or more forming units to said frame.

7. The adjustable stair forming apparatus as claimed in claim 1 wherein the riser height of a forming unit is adjusted by using varying riser forming members of different heights.

8. The adjustable stair forming apparatus as claimed in claim 1 wherein said first edge is rotatably mounted from or toward said upper edge at an abutment at or toward said upper edge.

9. The adjustable stair forming apparatus as claimed in claim 4 wherein said stair width is adjusted by a pair of side mould surfaces parallel to said first direction, both profiled to seal against said plurality of forming units and at least one of which is adjustable in location on said forming units.

10. The adjustable stair forming apparatus as claimed in claim 2 wherein said tread forming member is also pivotally mounted on a second axis, parallel to said first axis, to said frame at or toward said upper edge of said tread forming member.

11. The adjustable stair forming apparatus as claimed in claim 1 wherein said frame consists of a first and second parallel side frames that each run along a first side and second side of said plurality of forming units in said first direction that is perpendicular to said width direction.

12. The adjustable stair forming apparatus as claimed in claim 11 wherein said first and second parallel side frames include vertically spaced apart horizontally extending frame members comprising at least one adjustable frame member vertically moveable relative to the other of said frame members.

13. The adjustable stair forming apparatus as claimed in claim 11 wherein said tread forming members of said plurality of forming units are each pivotally and slidably connected, directly or indirectly, between said first and second side frames.

14. The adjustable stair forming apparatus as claimed in claim 12 wherein each said tread forming member is slidably and pivotally mounted to one of said frame members from or toward said upper edge and slidably and pivotally mounted to said adjustable frame member from or toward a location distal and below the upper edge of said tread forming member to allow (i) their horizontal spacing to be adjusted along said frame members and (ii) their angle to be varied relative to the vertical upon the movement of said one of said frame members and said adjustable frame member vertically relative each other.

15. The adjustable stair forming apparatus as claimed in claim 1 wherein said adjustment of said adjustable support means is by complimentary threaded components.

16. The adjustable stair forming apparatus as claimed in claim 1 wherein said tread forming members and said riser forming members are substantially rectangular in shape.

17. An adjustable stair forming apparatus, adapted to form a flight of stairs of a settable material in an inverted condition, said flight of stairs including a series of treads interconnected by intermediate risers, said apparatus comprising a plurality of forming units, acting in concert to collectively provide a forming surface, a frame to support said forming units, each of said forming units including (a) a tread defining formwork that includes a rectangular shaped tread forming surface, slidably and pivotally mounted to said frame from or toward a first major edge of said tread forming surface, and (b) a riser defining formwork that includes a rectangular shaped riser forming surface with a first major edge located at the opposite major edge of said tread forming surface in a rotationally adjustable manner relative thereto, said riser forming surface at least in part co-extending with said tread forming surface in a stair width direction, said riser forming surface including a bearing surface parallel to and distal from its said first major edge, said plurality of forming units each adjustably held in an array by and/or relative to said frame with said bearing surface of each riser defining formwork supported against the tread forming surface of an adjacent said forming unit by an adjustable support member that can move relative to the tread forming surface of the adjacent forming unit to allow it to be set in a position to support the riser in a position to define a desired amount of tread protection of the tread to be so formed.

18. An adjustable stair flight forming system to form a flight of stairs of a settable material in an inverted condition, said flight including a plurality of stairs each including a tread and a riser that extend substantially perpendicular to each other, adjustment of said system allowing for the forming of different flights of different shaped treads and/or risers to occur, said system comprising a frame, a plurality of tread defining formwork elements, each including a tread forming surface to each define said tread of a stair, movably engaged to and supported by said frame in a spaced apart manner, and at least two sets of a plurality of identical riser defining formwork elements, each including a riser forming surface to define said riser of a stair, wherein an angle between said tread forming surface and a said riser forming surface of each said stair can be adjustably set by an adjustable stop abutting said riser forming surface, said adjustable stop capable of movement that causes said riser forming surface to move forward or back, and setting the tread forming surfaces of adjacent stairs parallel to each other by virtue of:

(a) an adjustable support of each said tread defining formwork element relative said frame and relative the other said tread defining form work elements, and (b) selection of an appropriate set of said riser defining formwork elements that comprises of riser defining form work elements of a size that can span and close the space between adjacent said tread defining formwork elements.

19. An adjustable stair forming device, to form stairs of a settable material, each step of said stairs including a tread and a riser, wherein a landing is formed intermediate of a first and second set of steps, said device comprising two moulding apparatus to each mould a set of first and second set of steps, each moulding apparatus including a frame, a plurality of abutting forming units to receive the settable material, each forming unit reconfigurably mounted from said frame in:

(a) a pivotal manner about an axis parallel to pivot axes of the other forming units, said axis extending in a direction parallel to the width direction of stairs to be formed, and/or (b) a translational manner in a direction perpendicular to the width direction, each of said forming units comprising;

(i) a tread forming member defining a tread forming surface with an upper edge substantially parallel to a lower edge, and (ii) a riser forming member defining a riser forming surface that includes a. a first edge bearing on the tread forming member at or toward said upper edge of said tread forming member, and b. a bearing edge parallel to and distal from said first edge, said riser forming surface at least in part co-extending in said width direction with said tread forming surface, said plurality of forming units each arranged relative said frame with said bearing edge of one said forming unit located by an adjustable support at said tread forming surface of an adjacent said forming unit, adjustment of said support rotationally positioning said riser forming member relative said tread forming member to allow an angle between said riser forming surface and said tread forming surface to be varied to set a desired amount of tread protection, wherein prior to receiving said settable material, said forming units can be configured to a desired configuration, and wherein a first of said moulding apparatus can be configured relative to a second of said moulding apparatus to position a distal end located forming unit of said first moulding apparatus relative a distal end located forming unit of said second moulding apparatus in a manner to allow a landing forming member to span there between to allow the forming of a landing member intermediate of the set of steps defined by the first and second moulding apparatus.

20. An adjustable stair moulding device adapted to form stairs, comprising at least two apparatus that each include a series of adjustable forming units to act in concert to define a mould for a settable material to form the set of steps of a desired number of steps, said forming units each including a riser defining formwork and a tread defining formwork, wherein one of said riser defining formwork and tread defining formwork is part of a set of formwork, each formwork of said set of formwork being of an identically settable configuration, a landing formwork member that can be located intermediate of the distal end located formwork units of each of said apparatus, wherein said forming units are adjustably settable, including by selection of the appropriate set of formwork, to allow a setting of the following stair parameters:

tread depth, riser height, tread width, and tread protection.

* * * * *